US009060406B2

(12) United States Patent
Pereira et al.

(10) Patent No.: US 9,060,406 B2
(45) Date of Patent: Jun. 16, 2015

(54) POWER REGULATION OF LED BY MEANS OF AN AVERAGE VALUE OF THE LED CURRENT AND BIDIRECTIONAL COUNTER

(75) Inventors: Eduardo Pereira, Siebnen (CH); Michael Zimmermann, Heiligkreuz (CH); Alexander Barth, Alberschwende (AT); Markus Mayrhofer, Dornbirn (AT); Guenter Marent, Bartholomaeberg (AT)

(73) Assignees: TRIDONIC GMBH and CO KG, Dornbim (AT); TRIDONIC AG, Enneda (CH)

( * ) Notice: Subject to any disclaimer, the term of this patent is extended or adjusted under 35 U.S.C. 154(b) by 825 days.

(21) Appl. No.: 13/264,568

(22) PCT Filed: Mar. 26, 2010

(86) PCT No.: PCT/EP2010/054014

§ 371 (c)(1),
(2), (4) Date: Nov. 18, 2011

(87) PCT Pub. No.: WO2010/118944

PCT Pub. Date: Oct. 21, 2010

(65) Prior Publication Data

US 2012/0133295 A1 May 31, 2012

(30) Foreign Application Priority Data

Apr. 14, 2009 (AT) ..... GM 229/2009
Apr. 15, 2009 (DE) ..... 10 2009 017 139
Mar. 19, 2010 (DE) ..... 10 2010 003 054

(51) Int. Cl.
*H05B 33/08* (2006.01)

(52) U.S. Cl.
CPC ..... *H05B 33/0851* (2013.01); *H05B 33/0815* (2013.01); *H05B 33/0848* (2013.01)

(58) Field of Classification Search
USPC ..... 315/247, 185 S, 291, 307–326
See application file for complete search history.

(56) References Cited

U.S. PATENT DOCUMENTS

| | | | |
|---|---|---|---|
| 4,592,057 | A | 5/1986 | Comerford |
| 5,317,578 | A | 5/1994 | Ogou |
| 2005/0218838 | A1 | 10/2005 | Lys |
| 2006/0238174 | A1 | 10/2006 | Russell et al. |
| 2007/0016373 | A1 | 1/2007 | Hunter et al. |

(Continued)

FOREIGN PATENT DOCUMENTS

| | | | |
|---|---|---|---|
| EP | 0287360 | A2 | 10/1988 |
| WO | WO2006135836 | A1 | 12/2006 |

(Continued)

OTHER PUBLICATIONS

International Search Report PCT/EP2010/054014, dated Jun. 22, 2010, 8 pages.

*Primary Examiner* — Tuyet Vo
(74) *Attorney, Agent, or Firm* — Lee & Hayes, PLLC

(57) ABSTRACT

A circuit for the power regulation of an LED comprises a converter having a switch. The LED is interconnected in an output circuit, wherein a control unit controls the magnetization of an inductor, in that it actively clocks the switch. A measured actual value representative of the average value of the LED current is returned to the control unit and compared to a reference value.

35 Claims, 4 Drawing Sheets

(56) References Cited

U.S. PATENT DOCUMENTS

Figure 1:
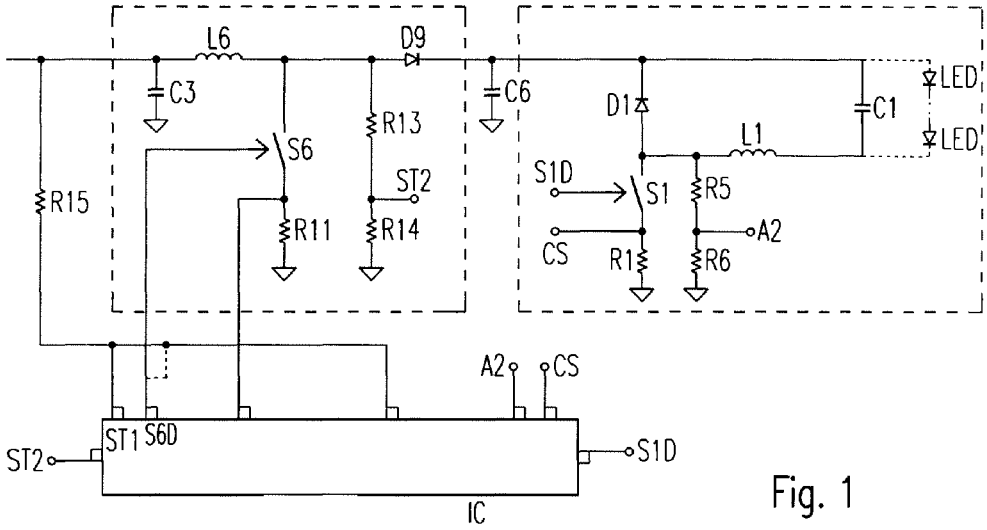

| | | | | |
|---|---|---|---|---|
| 2007/0097044 | A1 | 5/2007 | Yang | |
| 2007/0182346 | A1 | 8/2007 | Shteynberg et al. | |
| 2007/0229001 | A1 | 10/2007 | McIntosh et al. | |
| 2010/0045190 | A1 | 2/2010 | Cramer | |
| 2012/0104958 | A1* | 5/2012 | Zudrell-Koch et al. | 315/206 |
| 2014/0354186 | A1* | 12/2014 | Sun et al. | 315/310 |

FOREIGN PATENT DOCUMENTS

| | | | |
|---|---|---|---|
| WO | WO2007016373 | A2 | 2/2007 |
| WO | WO2007044948 | A2 | 4/2007 |

* cited by examiner

POWER REGULATION OF LED BY MEANS OF AN AVERAGE VALUE OF THE LED CURRENT AND BIDIRECTIONAL COUNTER

This Application is a National Stage of International Application No. PCT EP2010/054014, filed Mar. 26, 2010, which claims priority to Austrian Patent Application No. GM 229/2009, filed Apr. 14, 2009, German Patent Application No. 10 2009 017 139.8, filed Apr. 15, 2009, and German Patent Application No. 10 2010 003 054.6, filed Mar. 19, 2010, all of which are incorporated herein by reference.

The present invention relates to a circuit arrangement for operating light emitting diodes (LED), more particularly inorganic light emitting diodes or else organic light emitting diodes, which are used in electronic ballasts for corresponding light emitting diodes.

The invention also relates to a lighting system.

In the prior art, the switch-off instant of the switch is determined by the LED current attaining a fixedly predetermined switch-off threshold value. Inaccuracies occur in this case since the negative current flow range can vary directly after the switch-on of the switch, which makes the power regulation inaccurate.

The object of the invention, then, is to make more accurate the power regulation of an LED in a converter such as, for example, a boost converter (step-up converter), buck converter (also called step-down converter) or buck-boost converter (called flyback converter or else inverter).

This object is achieved by means of the features of the independent claims. The dependent claims develop the central concept of the invention in a particularly advantageous manner.

A first aspect of the invention relates to a method for the regulation, more particularly for the power regulation, of an LED in a converter having a switch.

In this case, the invention can equally be applied to:

- the so-called borderline mode or critical conduction mode, in which the demagnetization current falls to zero or crosses the zero line, which immediately triggers the switch-on of the switch and thus the renewed rising of the current,
- the continuous conduction mode, in which the renewed switch-on of the switch is effected before the current has fallen to zero, and
- the discontinuous conduction mode, in which the renewed switch-on of the switch is only effected again after the current has remained at the zero level during a time duration greater than zero.

The converter is formed by an actively clocked switch and passive energy storage elements having an inductance, for example. By way of example, such a converter can be a buck converter, buck-boost converter or flyback converter.

In this case, the LED is interconnected in the output circuit. An inductance is magnetized if the switch is actively clocked and a current flow takes place via the closed switch and the inductance. A measured actual value representative of the average value of the LED current is used as a feedback variable for the regulation, said actual value being compared with a reference value as desired value.

The duty ratio of the present switch-on process of the actively clocked switch and/or of a following switch-on process can be set depending on the difference between the actual value and the desired value.

In this case, the duty ratio of the actively clocked switch can be changed only upon every n-th switch-on process, where n is greater than or equal to 2.

The duty ratio of the actively clocked switch can be changed e.g. by means of the instant of the switch-off of the actively clocked switch as a controlled variable.

The duty ratio can be set by adaptively predetermining a switch-off level of a measured variable representative of the LED current, wherein the actively clocked switch is switched off when the switch-off level is reached.

The level of the DC bus voltage supplying the converter can be used as a controlled variable of the power regulation as an alternative or in addition to the clocking of the actively clocked switch.

The bus voltage can be generated by means of an active PFC circuit, wherein the level of the generated bus voltage is implemented by changing the clocking of a switch of the PFC circuit.

A sample of the LED current, preferably measured at half of the switched-on time duration of the actively clocked switch, can be as a measured actual value representative of the average value of the LED current.

The actual value representative of the average value of the LED current can be determined by a continuous measurement of the LED current (or of a variable representative thereof).

The continuously measured LED current can be compared with a reference value and the actual value representative of the average value can be the duty ratio of the comparison value over the switched-on time duration of the actively switched switch.

The duty ratio can be determined with the aid of a bidirectional digital counter.

The reference value can be dependent on a predetermined dimming value and/or the measured LED voltage.

The LED current can be generated by one of the following operating modes (with regard to the clocking of the switch, more particularly the renewed switch-on thereof):

- the so-called borderline mode or critical conduction mode, in which the demagnetization current falls to zero or crosses the zero line, which immediately triggers the switch-on of the switch and thus the renewed rising of the current,
- the continuous conduction mode, in which the renewed switch-on of the switch is effected before the current has fallen to zero, or
- the discontinuous conduction mode, in which the renewed switch-on of the switch is only effected again after the current remains at the zero level during a time duration greater than zero.

Dimming of the LED(s) can be effected by PWM, wherein the LED current is preferably generated in the continuous conduction mode in the switch-on time durations of a PWM pulse.

The invention also relates to an integrated circuit, more particularly an ASIC or a microcontroller or a hybrid thereof, which is designed for carrying out a method as explained above.

Furthermore, the invention relates to an operating device for an LED, comprising an integrated circuit of this type.

The invention also provides a circuit for the power regulation of an LED, which comprises a converter having a switch, wherein the LED can be interconnected in the output circuit. A control unit activates the switch, as a result of which the switch accepts the current flow and magnetizes the inductance, as a result of which the LED is supplied with a high-frequency voltage. A measured actual value representative of the average value of the LED current is fed back to the control unit, said actual value being compared with a reference value.

The control unit can set the duty ratio of the present switch-on process of the actively clocked switch and/or of a following switch-on process depending on a difference between the actual value and the desired value.

The control unit can change the duty ratio of the actively clocked switch only upon every n-th switch-on process, where n is greater than or equal to 2.

The control unit can change the duty ratio of the actively clocked switch by means of the instant of the switch-off of the actively clocked switch as a controlled variable.

The control unit can set the duty ratio by adaptively predetermining a switch-off level of a measured variable representative of the LED current, wherein the control unit switches off when the switch-off level is reached the actively clocked switch.

The control unit, alongside the regulation of the operation of the LED, also can drive an intermediate circuit and receive feedback signals from the intermediate circuit, wherein the intermediate circuit generates the DC bus voltage supplying the converter.

The control unit can use the level of the DC bus voltage supplying the converter as a controlled variable of the power regulation as an alternative or in addition to the clocking of the actively clocked switch.

An active PFC circuit can be provided for generating the bus voltage, wherein the control unit implements the level of the generated bus voltage by changing the clocking of a switch of the PFC circuit.

A sample of the LED current, preferably measured at half of the switched-on time duration of the actively clocked switch, can be fed back to the control unit as a measured actual value representative of the average value of the LED current.

The control unit can continuously measure the LED current in order to determine the actual value representative of the average value of the LED current (or a variable representative thereof).

The control circuit can have a comparator, which compares the continuously measured LED current with a reference value, and the control circuit uses the duty ratio of the output signal of the comparator as an actual value representative of the average value.

The output signal of the comparator can be fed to a bidirectional digital counter of the control circuit.

The control circuit can set the reference value depending on an externally or internally predetermined dimming value and/or the measured LED voltage fed to the control circuit.

The present invention is described in greater detail below on the basis of preferred exemplary embodiments with reference to the accompanying drawing.

Figure 2:
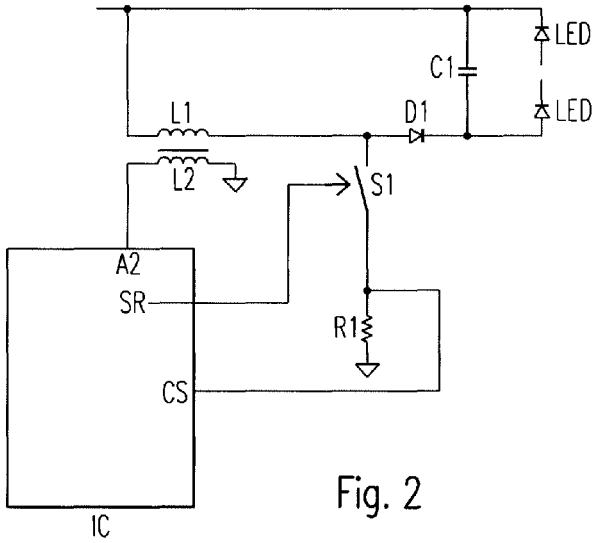
Figure 3:
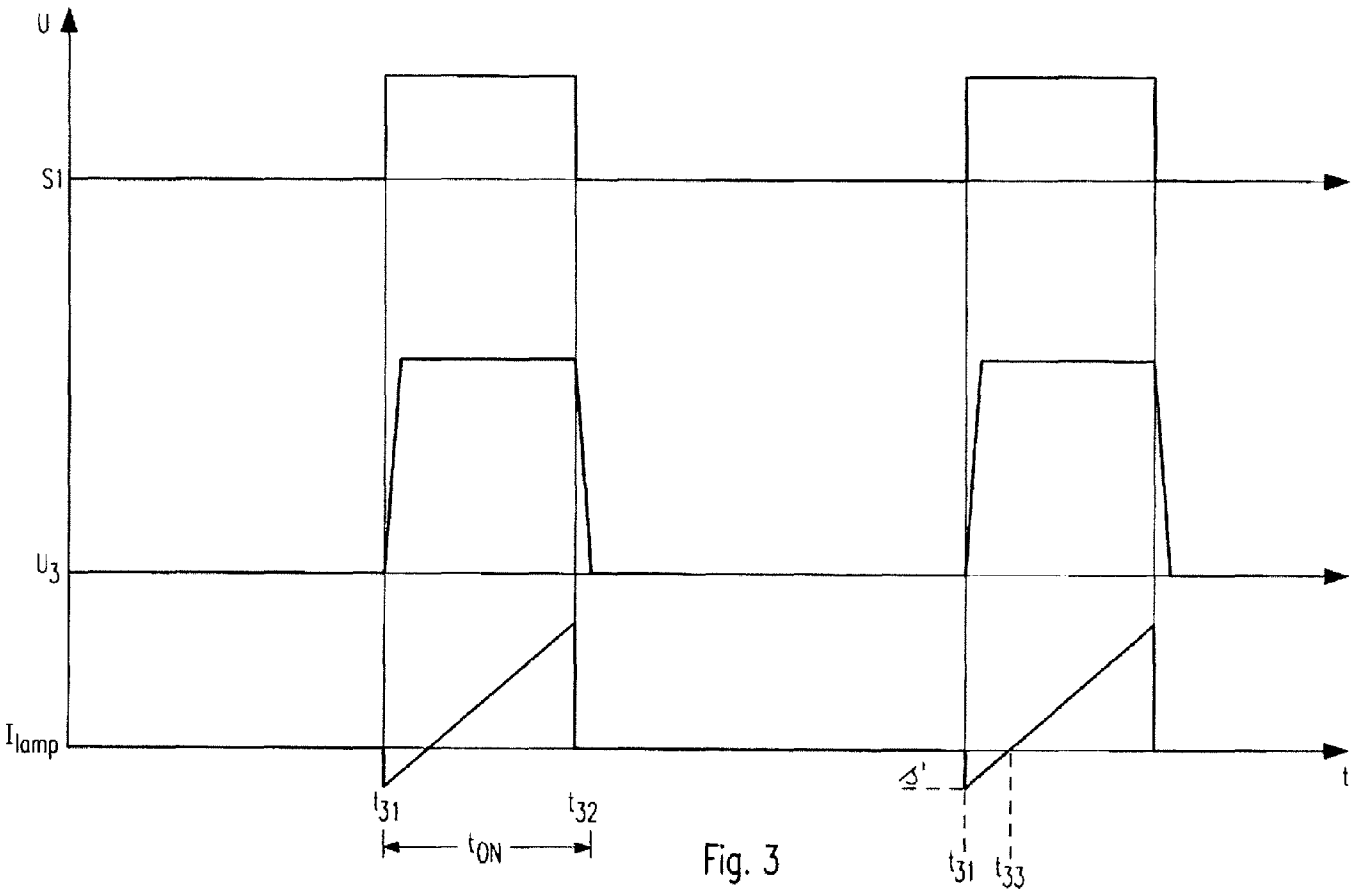
Figure 4:
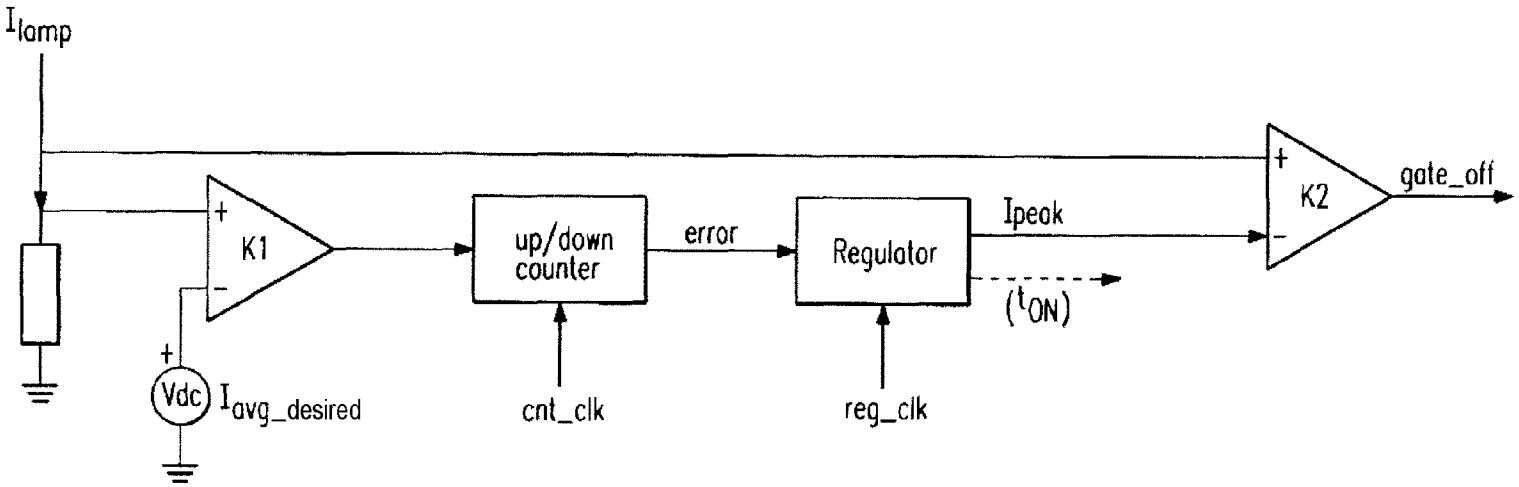
Figure 5:
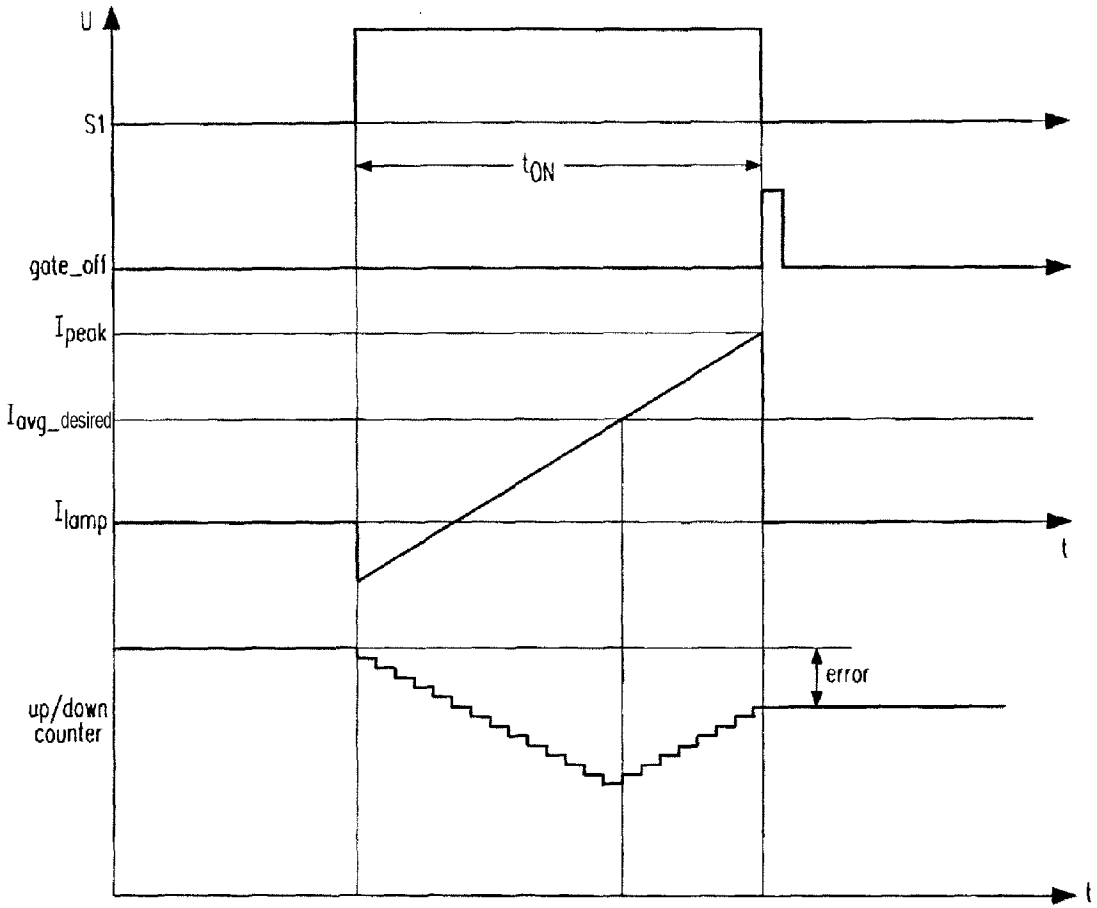

FIG. 1 shows an operative device according to the invention for LED interconnected in a buck converter, FIG. 2 shows in detail a circuit according to the invention for LED interconnected in a buck-boost converter, and also the measurement signals that can be tapped off there, FIG. 3 shows the profile of drive signals of a switch of the half-bridge and also of the center point voltage $U_{L3}$ and of the LED current $I_{LED}$, FIG. 4 shows the structure of a regulation of the LED current, FIG. 5 shows the temporal profile of signals of the regulation from FIG. 4, FIG. 1 shows an electronic ballast for operating LED.

FIG. 1 shows a converter for operating at least one LED and a circuit for power factor correction, wherein both circuits is controlled by a control unit IC.

On the input side, the electronic ballast comprises a rectifier—not illustrated—which is supplied with power supply system voltage and is adjoined by the active power factor correction circuit, which functions as a step-up converter.

The PFC circuit substantially comprises a coil L6, which is magnetized if the switch (transistor) S6 is closed in a predetermined manner in response to a drive command S6D from the integrated circuit IC.

If the switch S6 is opened, the energy of the magnetized coil L6 discharges via a diode D9 to the storage capacitor C6, such that a stepped-up DC voltage $U_{out}$ (bus voltage $U_{out}$) is established at the capacitor C6, said voltage having a triangular ripple with the frequency of the clocking of the switch S6.

At the pin ST2, with switch S6 open, firstly it is possible to measure the bus voltage $U_{out}$ at this pin; secondly, it is also possible to ascertain the instant of the demagnetization of the coil L6.

On the output side, the electronic ballast shown in FIG. 1 comprises a converter having a switch S1 and an inductance L1. A description of the further elements is given below.

The converter comprises a further switch S1 and is embodied as a buck converter. The current through the switch S1 can be fed to the control circuit IC at a pin CS by means of a measuring resistor (shunt) R1. At the pin S1D, a control signal for the switch S1 is output by the control circuit IC.

With switch S1 closed, the current flows through the light emitting diodes (LED) and an inductance L1 and rises approximately linearly with the magnetization of the inductance L1. With switch S1 switched off, the energy of the inductance L1 dissipates approximately linearly by a current flow in turn through the LEDs and the freewheeling diode D1 until the switch S1 is finally switched on again. By means of the voltage divider R5, R6, at a measurement point and pin A2 it is possible to determine the instant in that the magnetization of the inductance L1 has substantially dissipated and, consequently, the current is no longer driven on through the freewheeling path (diode D1, LED section, L1).

The renewed switch-on of the actively clocked switch S1 can be defined by the monitoring of the branch current iL1 flowing through the inductance L1. By way of example, it is possible to monitor whether the branch current iL1 flowing through the inductance L1 has fallen to zero again or whether the inductance L1 is demagnetized (critical conduction mode). This can be effected by means of a secondary winding at the inductance L1 or else by means of monitoring the voltage across the switch S1. The continuous conduction mode involves monitoring whether a the branch current has reached a lower switch-on threshold (greater than zero). The discontinuous conduction mode involves monitoring whether the branch current had already been at zero for a predetermined time duration before switch-on is effected. In said discontinuous conduction mode, the switched-off time duration $T_{off}$ is included for calculating the average value of the current with respect to time.

However, a renewed switch-on can also be effected on the basis of the elapsing of a specific time period of a direct current measurement in the path of the LED. However, a renewed switch-on can also be effected on the basis of the evaluation of the gradient of the rise of the detected LED current during the switch-on phase of the switch S1 and/or the duration of the switch-on phase of the switch S1. The present current value can also be evaluated directly or shortly after the renewed switch-on of the switch S1, in order to define, depending thereon, the duration of the switch-off phase and thus the next renewed switch-on instant.

Since the LED should be operated with a current that is as constant as possible, the renewed switch-on of the switch S1 before the complete demagnetization of the inductance L1 can be advantageous, primarily if no or only a very small capacitor C1 is present. A so-called continuous conduction mode can be achieved in this case.

The control circuit IC drives the converter and can furthermore carry out the PFC regulation.

Feedback signals from the region of the PFC intermediate circuit voltage can be fed back to the control unit, such as e.g.:

- the input voltage via a tap ST1,
- the current through the inductance L6 by means of a voltage divider ST2 (or a monitoring of the voltage across the inductance L6), and
- the bus voltage $U_{out}$ via the voltage divider ST2.

The control unit can set the level of the output voltage by the clocking of the switch S6 and can regulate it preferably digitally by means of the bus voltage fed back.

Feedback signals from the region of the load circuit containing the LED with the converter can be fed back to the control unit:

- the LED voltage $V_{LED}$ (for example determined by means of a comparison of the bus voltage fed back with the voltage at the voltage divider A2),
- the LED current $I_{LED}$ by means of the shunt R1 (only during the switch-on of the actively clocked switch S1), and
- the voltage across the switch S1 by means of a tap A2 (for example inductively or by a tap across the switch S1).

The LED voltage $V_{LED}$ can be evaluated for example as a parameter for the regulation of LED operation or else for fault identification.

In the discontinuous conduction mode as already mentioned, the switched-off time duration $T_{off}$ of the switch S1 can be included for calculating the average value with respect to time of the current through the LED. The switched-off time duration $T_{off}$ can be determined for example by means of the monitoring of the voltage across the switch S1. In this case, it is possible to identify the period of time over which a demagnetization of the inductance L1 is present (which corresponds to the switched-off time duration $T_{off}$). However, the switched-off time duration $T_{off}$ can, for example, also be determined or detected by an evaluation of the drive signal for the switch S1.

Preferably, in parallel with the LED, a capacitor C1 as filter or smoothing capacitor is connected in parallel. Said capacitor can smooth the LED voltage during operation and maintain the LED voltage during the demagnetization of the inductance L1. In this case, the current determined by the shunt R1 does not correspond exactly to the current flowing through the LED, but rather additionally also contains a current component flowing via the capacitor C1. This total current can also be utilized for the power regulation according to the invention, since the current through the shunt R1 in turn represents a measure of the present power in the output circuit if it is assumed that the bus voltage $U_{out}$ is constant (e.g. on the basis of the regulation of the PFC) or is known on the basis of a measurement. Therefore, this total current, too, is designated hereinafter as LED current.

A low-resistance shunt R1 is interposed between the switch S1 and the negative pole of the DC voltage source, but said shunt serves only for measuring currents and has no measurable influence on the voltages in the circuit.

A change in brightness (dimming) of the LED is preferably achieved by pulsed operation (periods with virtually constant LED current are interrupted by periods without current flow, PWM). The method according to the invention is suitable for this operation, in particular when a continuous conduction mode is employed, which is carried out in the switched-on time durations of PWM operation.

In this case, it can be provided that when the LEDs are switched on, the or the first PWM pulses of a pulse train are lengthened in a targeted manner in order that a storage capacitor that is usually connected in parallel with the LED section is charged to the desired voltage more rapidly.

FIG. 2 shows a converter for operating at least one LED, wherein this circuit is controlled by a control unit IC. A circuit for power factor correction can be connected upstream of the converter.

The converter comprises a further switch S1 and is embodied as a buck-boost converter. The current through the switch S1 can be fed to the control circuit IC at a pin CS by means of a measuring resistor (shunt) R1. At the pin SR, a control signal for the switch S1 is output by the control circuit IC.

With switch S1 closed, the current flows through an inductance L1 and rises substantially linearly with the magnetization of the inductance L1. The LED are fed by the capacitor C1 during this phase. With switch S1 switched off, the energy of the inductance L1 dissipates substantially linearly by a current flow through the LEDs and the freewheeling diode D1 until the switch S1 is finally switched on again. By means of the secondary winding L2 on the inductance L1, at a measurement point and pin A2 it is possible to determine the instant at which the magnetization of the inductance L1 has substantially dissipated and, consequently, the current is no longer driven on through the freewheeling path (diode D1, LED section, inductance L1).

The renewed switch-on of the actively clocked switch S1 can be defined by the monitoring of the branch current iL1 flowing through the inductance L1. By way of example, it is possible to monitor whether the branch current iL1 flowing through the inductance L1 has fallen to zero again or whether the inductance L1 is demagnetized. This can be effected by means of a secondary winding at the inductance L1 or else by means of monitoring the voltage across the switch S1. However, a renewed switch-on can also be effected on the basis of the elapsing of a specific time period of a direct current measurement in the path of the LED. However, a renewed switch-on can also be effected on the basis of the evaluation of the gradient of the rise of the detected LED current during the switch-on phase of the switch S1 and/or the duration of the switch-on phase of the switch S1. The present current value can also be evaluated directly or shortly after the renewed switch-on of the switch S1, in order to define, depending thereon, the duration of the switch-off phase and thus the next renewed switch-on instant.

The control circuit IC drives the converter and can furthermore carry out the PFC regulation.

Feedback signals from the region of the load circuit containing the LED with the converter can be fed back to the control unit:

- the LED voltage $V_{LED}$ by means of a voltage divider (not illustrated) arranged in parallel with the LED,
- the LED current $I_{LED}$ (e.g. by means of shunt R1), and
- the voltage across the switch S1 by means of a tap A2 (inductively or by a tap across the switch S1).

Preferably, in parallel with the LED, a capacitor C1 as filter or smoothing capacitor is connected in parallel. Said capacitor can smooth the LED voltage during operation and can maintain the LED voltage during the magnetization or else during the demagnetization of the inductance L1.

A low-resistance shunt R1 is interposed between the switch S1 and the negative pole of the DC voltage source, but said shunt serves only for measuring currents and has no measurable influence on the voltages in the circuit.

FIG. 3 illustrates signal profiles during the switch-on and switch-off at the switch S1. In this case, as is evident, the switch S1 is actively clocked and switched on between the instants $T_{31}$ and $T_{32}$ (time duration $t_{ON}$). As is evident, the linearly rising LED current $I_{LED}$ can only be detected at the shunt R1 during the time duration $t_{ON}$ during which the switch S1 is switched on. In the time duration during which the switch S1 is switched off, and in which the inductance L1 drives on the current through the LED falling to the lower reversal point, by contrast, the LED current cannot be detected by means of the shunt R1.

The switch-on instant of the switch S1 clocked at high frequency can be defined by the monitoring of the branch current iL1 flowing through the inductance L1. By way of example, it is possible to monitor whether the branch current iL1 flowing through the inductance L1 has fallen again to zero or whether the inductance L1 is demagnetized. This can be effected by means of a secondary winding at the inductance L2 or else by means of a monitoring of the voltage across the switch S1.

In the prior art, the switch-off instant of the switch S1 clocked at high frequency is defined by when the LED current attains a defined threshold value Ipeak. In this case—as already explained in the introduction possible fluctuations of the maximum negative current—level ΔI at the reversal point T31 and the is not taken into consideration, which makes this type of power regulation inaccurate.

According to the invention, the switch-off instant of the actively clocked switch (switch S1 in the example in FIG. 2) is now configured in an adaptive fashion, such that the switched-on time duration $t_{ON}$ is variable as a result. This can be achieved e.g. by the switch-off threshold for the LED current being configured in an adaptive fashion and/or by the switched-on time duration of the actively clocked switch being adaptively adjustable.

In this case, the adaptation is effected on the basis of a feedback signal representative of the average value of the LED current (averaging over one or more switched-on time durations of the actively clocked switch). As a result of regulation to the average value of the LED current, the lamp power regulation is significantly more accurate.

The average value of the LED current can be detected by a sample being detected and evaluated at the instant $t_{on}/2$, that is to say at half of the switched-on time duration $t_{ON}$ of the actively clocked switch. If said sample is higher than the desired average value, the switched-on time duration or the switch-off current threshold can be reduced, to be precise in the present or in a following switch-on process of the actively clocked switch.

(In the discontinuous conduction mode, as mentioned, the switched-off time duration $T_{off}$ is included for calculating the average value of the current with respect to time.)

However, an exemplary embodiment wherein the LED current is continuously detected and fed back to the control unit will be explained below.

As shown in FIG. 4, in the control unit, the LED current $I_{LED}$ is compared with a reference value $I_{avg_desired}$ by a comparator K1. Said reference value $I_{avg_desired}$ therefore predetermines the desired average value for the LED current and can be dependent e.g. on an external or internal dimming value predetermination and/or the magnitude of the LED voltage. Said reference value $I_{avg_desired}$ is a measure of the desired power.

In order to obtain a constant lamp power, with a fluctuating LED voltage $V_{LED}$, the desired value predetermination for the average value of the LED current has to be tracked inversely, such that the resulting product of LED current and LED voltage remains regulated in a constant fashion. With a constant LED voltage, of course, an average current regulation corresponds exactly to a lamp power regulation.

In this exemplary embodiment, the aim of the regulation is for the duty ratio of the output of the comparator K1 during a switched-on time duration $t_{ON}$ of the actively clocked switch to be 50%. In the exemplary embodiment, for this purpose, the output signal of the comparator is fed to a digital up/down counter COUNTER, which is clocked by a timer of the control unit (clock signal CNT_CLK). As is evident in FIG. 5, the counter COUNTER counts in one direction as long as the LED current $I_{LED}$ lies below the reference value Iavg_desired, and in the opposite direction as soon as the LED current $I_{LED}$ exceeds the reference value $I_{avg_desired}$. If the actual value of the average value of the LED current $I_{LED}$ corresponds exactly to the reference value predetermination Iavg_desired, the duty ratio of the comparison signal fed to the counter COUNTER will be 50% and, consequently, at the end of a switched-on time duration the counter reading will correspond exactly to its initial state.

Any deviation will lead, however, to a deviation ERROR of the end state of the counter from the initial state thereof. This deviation signal ERROR is fed to a preferably digital regulator REGULATOR, which is likewise clocked by a signal reg_clk from a timer of the control unit. The regulator REGULATOR implements a regulation strategy (e.g. PI regulator) and, depending on the input signal ERROR and the regulation strategy, drives a manipulated variable that influences the power of the LED. Said manipulated variable can be e.g. one or a plurality of:

bus voltage, adaptive switched-off threshold Ipeak, and/or adaptive switched-on time duration Ton.

The manipulated variable(s) can be changed in the present switch-on process, in any following switch-on process or else in every n-th switch-on process, where n is an integer greater than or equal to 2.

In the example in FIGS. 4 and 5, either the switched-on time duration Ton is changed, or else the regulator REGULATOR changes the reference value of a further comparator K2 of the control unit, at the noninverting input of which comparator the LED current $I_{LED}$ is present.

The output signal of the further comparator K2 controls the switch-off gate off of the switch.

The converter for the LED can also be, for example, a boost converter or a flyback converter.

The invention claimed is:

1. A method for regulation of an LED of an output circuit with a converter having a switch, the method comprising:

actively clocking the switch to magnetize an inductance in an inductor;

measuring an actual value representative of an average value of the LED current ($I_{LED}$) for use as a feedback variable;

comparing the actual value to a reference value ($I_{AVG_DESIRED}$); and regulating the LED based on the comparison of the actual value to the reference value.

2. The method as claimed in claim 1, further comprising switching on the actively clocked switch if an indirectly or directly detected current has decayed to zero or has reached its lower reversal point.

3. The method as claimed in claim 1, wherein a duty ratio of a present switch-on process of the actively clocked switch, and/or of a following switch-on process, is set depending on a difference between the actual value and the reference value.

4. The method as claimed in claim 1,
wherein a duty ratio of the actively clocked switch is set by adaptively predetermining a switch-off level of a measured variable representative of the LED current,
the method further comprising switching off the actively clocked switch if the switch-off level is reached.

5. The method as claimed in claim 1,
wherein the LED current is generated by one of the following operating modes:
a borderline mode or critical conduction mode, in which a demagnetization current falls to zero or crosses the zero line, which immediately triggers a switch-on of the switch and thus the renewed rising of the current,
a continuous conduction mode, in which a renewed switch-on of the switch is effected before current has fallen to zero, or
a discontinuous conduction mode, in which a renewed switch-on of the switch is only effected again after current remains at the zero level during a time duration greater than zero.

6. The method as claimed in claim 1,
wherein dimming of the LED(s) is effected by pulse width modulation (PWM), wherein the LED current is preferably generated in a continuous conduction mode in switched-on time durations of a PWM pulse.

7. The method as claimed in claim 3,
wherein the duty ratio of the actively clocked switch is changed upon every n-th switch-on process, where n is greater than or equal to 2.

8. The method as claimed in claim 3,
wherein the duty ratio of the actively clocked switch is changed by a switch-off of the actively clocked switch as a controlled variable.

9. The method as claimed in claim 1,
wherein a level of a direct current (DC) bus voltage supplying the converter is used as a controlled variable for power regulation as an alternative or in addition, to the clocking of the actively clocked switch.

10. The method as claimed in claim 9,
wherein the DC bus voltage is generated by an active power factor correction (PFC) circuit, wherein the level of the generated bus voltage is implemented by changing a clocking of a switch of the PFC circuit.

11. The method as claimed in claim 1,
wherein a sample of the LED current, measured at half of the switched-on time duration of the actively clocked switch, is used as a measured actual value representative of the average value of the LED current.

12. The method as claimed in claim 11,
wherein the reference value is dependent on a predetermined dimming value and/or a measured LED voltage.

13. An application specific integrated circuit, which is designed for carrying out the method of claim 1.

14. An operating device for an LED, comprising an ASIC as claimed in claim 13.

15. The method as claimed in claim 1,
wherein the actual value representative of the average value of the LED current is determined by a continuous measurement of the LED current.

16. The method as claimed in claim 15,
wherein the continuously measured LED current is compared with a reference value and the actual value representative of the average value is a duty ratio of the comparison value over a switched-on time duration of the actively clocked switch.

17. The method as claimed in claim 16,
wherein the duty ratio is determined with the aid of a bidirectional digital counter.

18. A circuit for the power regulation of a light emitting diode (LED), the circuit comprising:
a converter having a switch;
an LED interconnected at an output of the circuit;
a control unit to control magnetization of an inductance by actively clocking the switch;
wherein a measured actual value representative of an average value of the LED current is fed back to the control unit, said actual value being compared with a reference value.

19. The circuit as claimed in claim 18,
wherein the control unit changes a duty ratio of the actively clocked switch by a switch-off of the actively clocked switch as a controlled variable.

20. The circuit as claimed in claim 18,
wherein the control unit sets a duty ratio of the actively clocked switch by adaptively predetermining a switch-off level of a measured variable representative of the LED current, wherein the control unit switches off if the switch-off level is reached for the actively clocked switch.

21. The circuit as claimed in claim 18,
wherein the control unit regulates operation of the LED, and drives an intermediate circuit and receives feedback signals from the intermediate circuit, wherein the intermediate circuit generates a direct current (DC) bus voltage supplying the converter.

22. The circuit as claimed in claim 18,
wherein the reference value depends on an externally or internally predetermined dimming value and/or the measured LED voltage fed to the control circuit.

23. The circuit as claimed in claim 18,
wherein the control unit is embodied as a digital circuit.

24. The circuit as claimed in claim 18,
wherein the control unit is embodied as an application specific integrated circuit.

25. The circuit as claimed in claim 18,
wherein the control unit uses a level of a direct current (DC) bus voltage supplying the converter as a controlled variable the for power regulation as an alternative, or in addition, to the clocking of the actively clocked switch.

26. The circuit as claimed in claim 25,
wherein an active power factor correction (PFC) circuit is provided for generating the DC bus voltage,
wherein the control unit implements a level of the generated DC bus voltage by changing the clocking of a switch of the PFC circuit.

27. The circuit as claimed in claim 18,
wherein a sample of the LED current, measured at half of the switched-on time duration of the actively clocked switch, is fed back to the control unit as a measured actual value representative of the average value of the LED current.

28. The circuit as claimed in claim 27,
wherein an output signal of the comparator is fed to a bidirectional digital counter of the control unit.

29. The circuit as claimed in claim 18,
wherein the control unit continuously measures the LED current in order to determine the actual value representative of the average value of the LED current.

30. The circuit as claimed in claim 29,
wherein the control unit has a comparator, which compares the continuously measured LED current with a reference value, and the control unit uses a duty ratio of an output signal of the comparator as an actual value representative of the average value.

31. The circuit as claimed in claim 18, wherein the control unit sets a duty ratio of a present switch-on process of the actively clocked switch and/or of a following switch-on process depending on a difference between the actual value and the reference value.

32. The circuit as claimed in claim 31, wherein the control unit changes the duty ratio of the actively clocked switch upon every n-th switch-on process, where n is greater than or equal to 2.

33. An operating device for LED, comprising a circuit as claimed in claim 18.

34. A luminaire, comprising an LED and an operating device as claimed in claim 33.

35. A lighting system, comprising a plurality of luminaires, including at least one luminaire as claimed in claim 34, wherein the luminaires are connected among one another and/or to a central control unit by one or a plurality of bus lines.

* * * * *